US005535704A

United States Patent [19]

Paul

[11] Patent Number: 5,535,704

[45] Date of Patent: Jul. 16, 1996

[54] VALVE-ACTUATING MECHANISM

[75] Inventor: Michael Paul, Bad Friedrichshall, Germany

[73] Assignee: Audi AG, Germany

[21] Appl. No.: 406,971

[22] PCT Filed: Sep. 18, 1993

[86] PCT No.: PCT/EP93/02528

§ 371 Date: Mar. 28, 1995

§ 102(e) Date: Mar. 28, 1995

[87] PCT Pub. No.: WO94/08129

PCT Pub. Date: Apr. 14, 1994

[30] Foreign Application Priority Data

Sep. 30, 1992 [DE] Germany ..... 42 32 848.9

[51] Int. Cl.[6] ..... F01L 1/18; F01L 1/26; F01L 13/00

[52] U.S. Cl. ..... 123/90.16; 123/90.22

[58] Field of Search ..... 123/90.15, 90.16, 123/90.17, 90.22, 90.27, 90.39, 90.44

[56] References Cited

U.S. PATENT DOCUMENTS

| | | | |
|---|---|---|---|
| 4,901,685 | 2/1990 | Fukuo et al. | 123/90.16 |
| 5,297,505 | 3/1994 | Doll et al. | 123/90.16 |
| 5,351,661 | 10/1994 | Doll | 123/90.16 |
| 5,406,835 | 4/1995 | Doll | 123/90.16 |

FOREIGN PATENT DOCUMENTS

| | | |
|---|---|---|
| 213759 | 3/1987 | European Pat. Off. . |
| 3526543 | 2/1986 | Germany . |
| 3800347 | 9/1988 | Germany . |
| 4205230 | 8/1993 | Germany . |
| 2162246 | 1/1986 | United Kingdom . |

*Primary Examiner*—Weilun Lo
*Attorney, Agent, or Firm*—Lalos & Keegan

[57] ABSTRACT

A valve-actuating mechanism for a multicylinder internal combustion engine has, for each inlet valve of a cylinder, a low engine speed cam and a high engine speed cam. A first rocker arm cooperates with the low engine speed cam and the valve, while a second rocker arm cooperates only with the high engine speed cam and in the high engine speed range can be coupled to the first rocker arm in order to operate the valve in accordance with the contour of the high engine speed cam. The coupling between the first and second rocker arms is effected by means of a piston which can be moved by a pressure medium and which is acted on by the latter only when sufficient time remains to bring the piston into its coupling position before the commencement of the lifting phase of the valve in question.

5 Claims, 3 Drawing Sheets

VALVE-ACTUATING MECHANISM

BACKGROUND OF THE INVENTION

The invention relates to a valve-actuating mechanism for a multicylinder internal combustion engine.

In valve-actuating mechanisms for multicylinder internal combustion engines, which are, for example, known from EP-A-0 213 759 and DE-A-38 00 347, the problem arises that on the change-over, that is to say when the second or high engine speed cams are to come into action through the coupling of the two rocker arms of each valve, the pistons serving as coupling elements of all the coupling devices are loaded with the pressure medium, so that so-called edge bearers may result, because, after the commencement of the pressure loading, the pistons need a certain period of time to pass into their second position. If the pressure loading starts at a moment in time only shortly before the commencement of the lifting phase of the rocker arms in question, the piston will not yet be in its second end position when the lifting phase starts and will therefore, for example, project only slightly into the bore in the second rocker arm, with the consequence that a considerable surface pressure will occur, which leads to heavy wear. In order to solve this problem it is known (DE-C 35 26 543) to provide a mechanical locking means for the piston, which will free the piston only during the lifting phase of the respective valve, so that sufficient time will be available for the movement of the piston before the commencement of the next lifting phase. This solution of the problem discussed is however relatively expensive and is limited to one very specific valve-actuating mechanism.

Another solution of this problem is known from US-A-4 901 685. The coupling means disclosed therein for coupling a first and second rocker arm are controlled by control means such that they are inoperative during the initial interval of the valve opening motion. However, with this method of controlling the operation of the coupling means it can not be ensured that the movement of each coupling element is completed before the lifting phase of the respective rocker arm.

SUMMARY OF THE INVENTION

The problem underlying the invention is that of ensuring by simple means, in a valve-actuating mechanism of the type described, a complete movement of each coupling element to its second end position in the coupling operation.

According to the invention a control valve or a similar control device of the valve-actuating mechanism is actuated to apply pressure to the coupling elements such that after the commencement of the pressure loading to the coupling elements sufficient time will be available for each coupling element to reach its second end position. This is achieved through the fact that the device for controlling the pressure loading of the coupling element, normally a control valve in the pressure medium supply pipe, is opened at the appropriate moment, which is possible with the aid of the usual electronic engine control devices without additional expense, since these devices already, for example, determine the ignition timing selectively for each cylinder, that is to say, the top dead center position of the internal combustion engine piston and thus also the position of the cams for the valves of the respective cylinder.

The proposal according to the invention can be applied to different valve-actuating mechanisms, for example also those described in DE-A-42 05 230.

In the shaft on which all the rocker arms are mounted, a longitudinal channel is normally provided, through which the pressure medium is fed to the bores which are provided in the rocker arms in question and which contain the pistons. With a configuration of this kind, in order to apply the principle of the invention a shut-off valve may be provided upstream, in the direction of flow of the pressure medium in the longitudinal channel, of each of the rocker arms of the inlet or outlet valve of a cylinder, while, when the change-over is made, the shut-off valves lying one behind the other in the direction of flow are opened one after the other, in each case at a moment of time such that sufficient time is left for the pistons in the following rocker arms to reach their end position. It is thereby ensured that, after initiation of the change-over operation, all the pistons will be loaded with pressure one after the other at the correct moment in time.

In some cases it is not necessary to provide a shut-off valve in the longitudinal channel upstream of the rocker arm of the valves of each cylinder, namely when in successive cylinders the "permissible" change-over times—that is the change-over times within which pressure loading of the coupling pistons must take place to ensure reliable movement of the pistons into their second end position—overlap. In an internal combustion engine having a bank of four cylinders and with the ignition sequence 1-3-4-2, this is for example the case for the rocker arms of the valves of cylinders 1 and 2 and of cylinders 3 and 4. It therefore becomes possible to provide in the supply channel a first shut-off valve upstream of the rocker arms for the inlet or outlet valve of the first cylinder, and a second shut-off valve upstream of the rocker arms for the inlet or outlet valve of the third cylinder. The first shut-off valve can then be formed by the control valve which initiates the coupling operation in dependence on engine speed and/or load.

In an embodiment of the present invention it is assumed that the pressure medium is fed to the longitudinal channel at one end, while the other end is closed. It would however also basically be possible to provide the rocker arms of the valves of determined cylinder groups with their own longitudinal channels in the common rocker arm shaft, for example by interrupting the longitudinal channel between the second and third cylinders in a bank of four cylinders, and supplying the pressure medium from both sides by way of a control valve, which is then actuated both in dependence on operating parameters and in dependence on the position of the cams in question.

The valve-actuating mechanism according to the invention can be used for an internal combustion engine having more than one inlet valve per cylinder, that is to say also for an internal combustion having two inlet valves (DE-C 35 26 543) or having three inlet valves per cylinder (DE-A 42 05 230), while it is possible to actuate not all, but only one or two of the inlet valves by means of different cams.

The longitudinal channel carrying the pressure medium in the rocker lever shaft is normally connected by branch channels to the bearings of the rocker arms on the rocker arm shaft, in order to lubricate such bearings. In order to ensure lubrication of the rocker arm bearings in the case of the proposal according to which shut-off valves are provided in the longitudinal channel, the closure members of the shut-off valves may be provided with throttle channels which permit a throttled flow to the rocker arm bearings when the shut-off valves are closed. The shut-off valves are in this case preferably disposed in the bearings of the rocker arm shaft.

BRIEF DESCRIPTION OF THE DRAWINGS

One exemplary embodiment of the invention is described below with reference to the drawings, in which.

DETAILED DESCRIPTION

Figure 1:
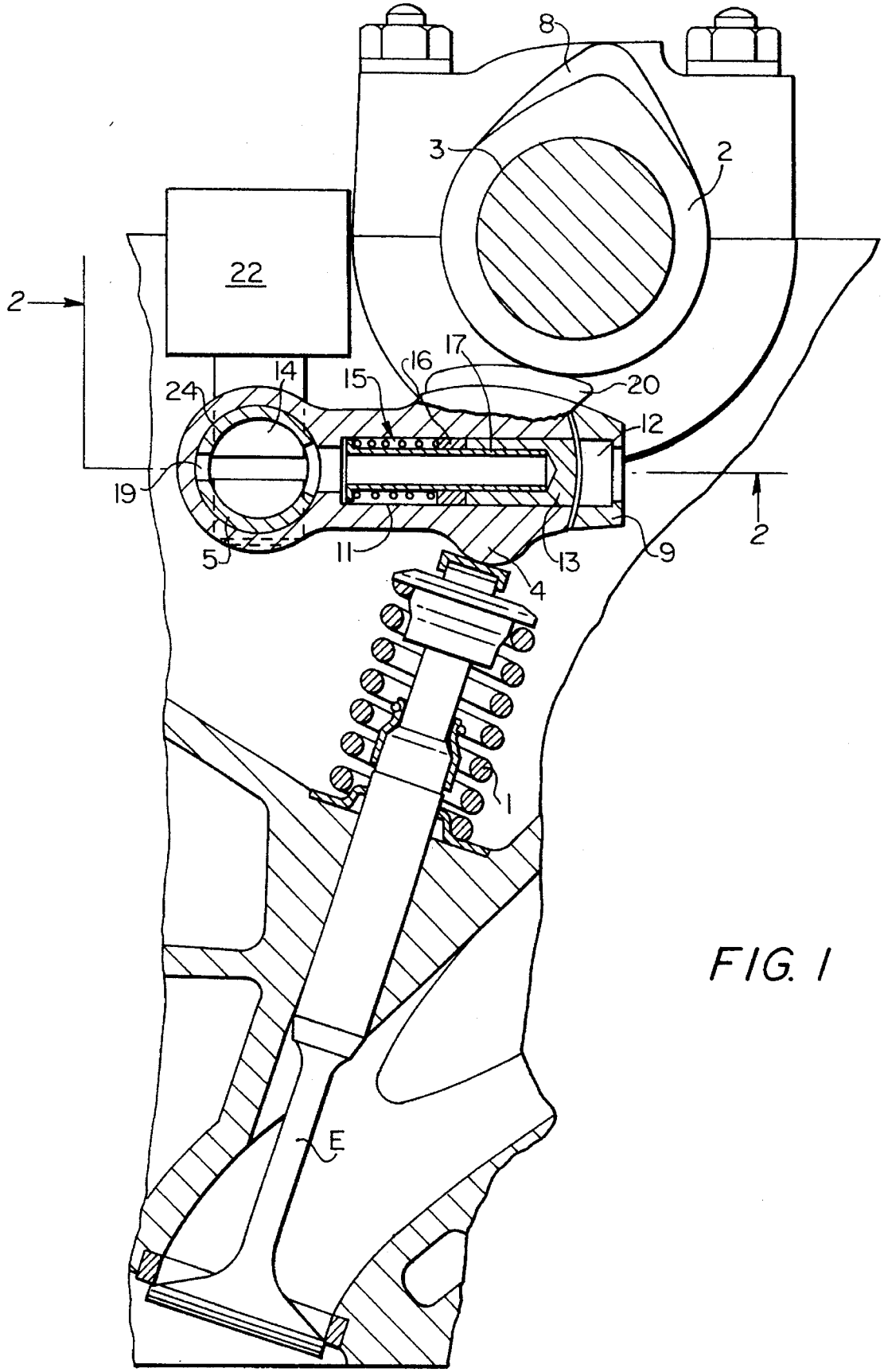
FIG. 1 shows a valve gear provided with a valve-actuating mechanism according to the invention for two inlet valves per cylinder, in a vertical section along the line 1—1 in FIG. 2.
Figure 2:
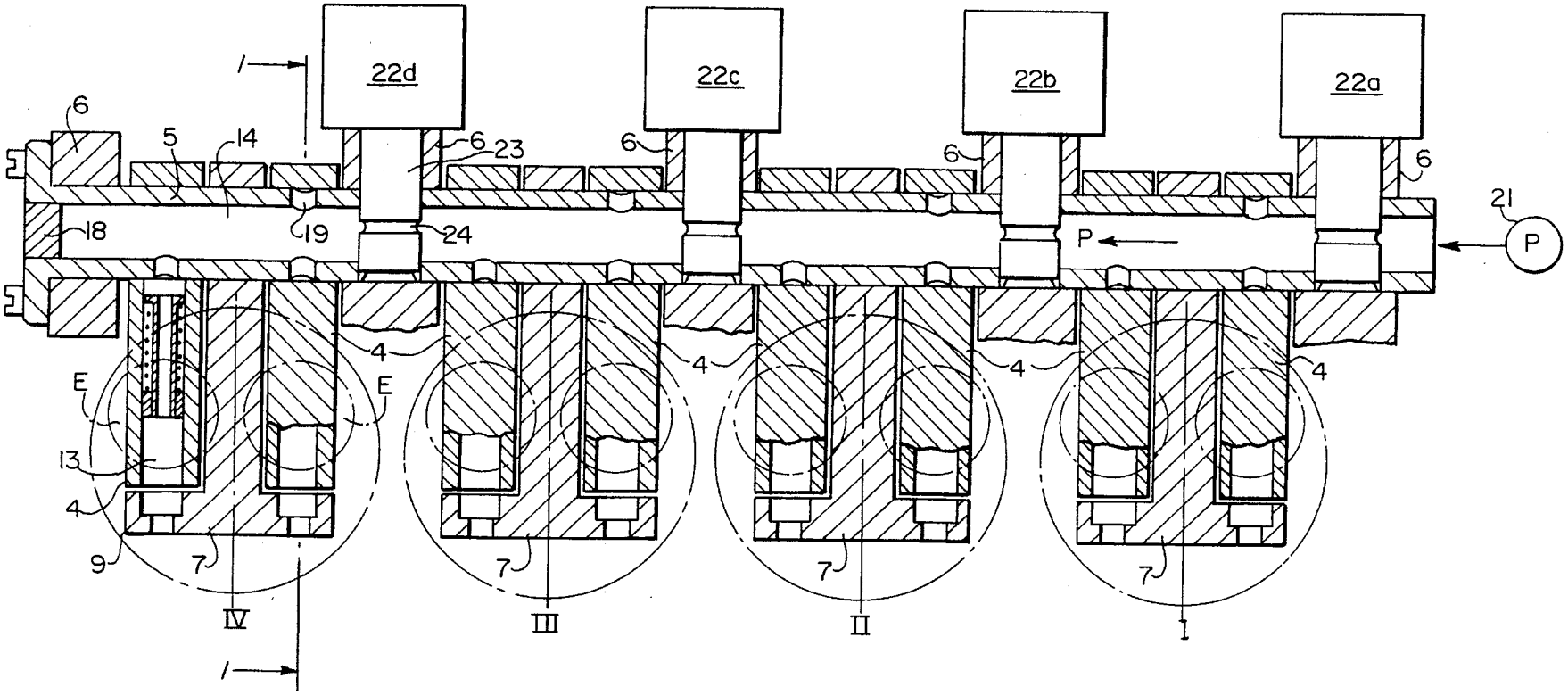
FIG. 2 shows a section along the line 2—2 in FIG. 1.

FIGS. 1 and 2 illustrate a valve gear for a four-cylinder internal combustion engine having two inlet valves E for each cylinder I to IV. Each valve E is loaded by a spring 1 in the closing direction. Each valve E is actuated by its own cam 2 of a camshaft 3 with the aid of a rocker arm 4. The rocker arms 4 are mounted pivotally on a common stationary shaft 5, which in turn is held in bearings 6 in the cylinder head of the internal combustion engine. Between the rocker arms 4 associated with the inlet valves of a cylinder there is disposed in each case a second rocker arm 7 cooperating with a cam 8 which is disposed between the two cams 2 associated with the rocker arms 4 and which has a cam profile designed for conditions in the upper engine speed range of the internal combustion engine, that is to say, for example, which produces a greater valve lift and a longer opening time than the cams 2. In the upper engine speed range each second rocker arm 7 can be coupled to the neighboring first rocker arms 4, so that in this engine speed range the valves E are actuated in accordance with the contour of the cam 8.

The free end of each second rocker arm 7 has a cross member 9 which extends in front of and at a short distance from the free ends of the first rocker arms 4. In the first rocker arms 4 bores 11 are provided, which extend radially in relation to the shaft 5 and which are in line with bores 12 in the cross member 9 when the valves E are closed, that is to say when all the rocker arms 4 and 7 lie against the base circles of their cams 2 and 8, respectively. Each bore 11 contains a piston 13 which, by means of a pressure medium supplied through a channel 14 in the shaft 5, is pushed outwards and engages in the bore 12 in the cross member 9, whereby the rocker arms 4 and 7 are coupled together. Each piston 13 is acted on by a spring 15, which is supported at one end against an insert 16 fixed in the bore 11 and at the other end against the end of a sleeve 17 fastened to the piston 13 and extending through the insert 16. The spring 15 returns the piston 13 to its uncoupled position when the supply of pressure medium to the bore 11 is interrupted, the insert 16 acting as a stop for the piston 13. The channel 14 is in communication by way of bores 19 with the bearings of the rocker arms 4 and 7 on the shaft 5, so that these bearings are lubricated. The channel 14 is closed by a stopper 18 at its left-hand end (in FIG. 2), while its right-hand end can be brought into communication with a pressure source 21 when the pistons 13 are to be moved to their coupling position, as will be described hereinafter.

Each rocker arm 4, 7 has a sliding surface 20 by which it lies against its cam 2 or 8 respectively. The second rocker arms 7 are held against their cams 8 by spring elements (not shown).

Figure 3:
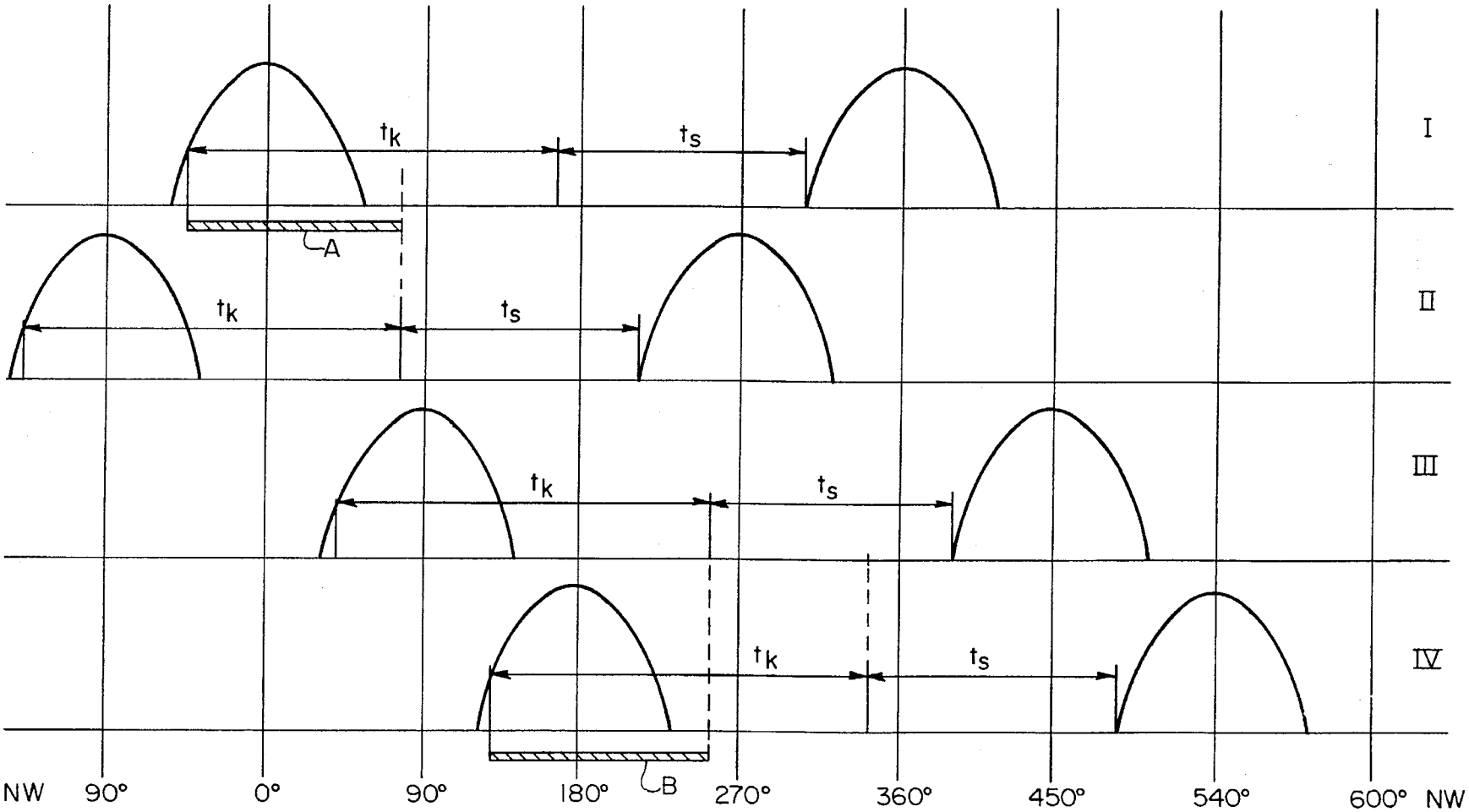
FIG. 3 shows the valve lift curves for the inlet valves of a four-cylinder internal combustion engine with the ignition sequence 1-3-4-2.

When the valves E are to be actuated by the cams 8, pressure medium, normally lubricating oil, is fed from the oil circuit of the internal combustion engine to the channel 14. The pistons 13 need a certain time to move, against the action of the springs 15, from their uncoupled first end position shown in FIGS. 1 and 2 to their second end position, in which they engage in the bores 12 in the cross member 9 of the second rocker arms 7 and lie against the end of said bores 12. This complete engagement of the pistons 13 can occur only when the bores 11 and 12 are in line with one another during the entire period of time $t_s$ (FIG. 3). Because of the different contours of the cams 2 and 8, this is the case substantially only during the period of time in which the rocker arms 4 and 7 are running on the bases circles of their cams 2 and 8. If the period of time from the application of pressure to the pistons 13 until the commencement of the lifting phases of the rocker arms 4 and 7 is shorter than the period of time required for the complete movement of the pistons 13, the piston 13 will not go as far as the end of the bore 12 because the rocker arms 4 and 7 make a movement relative to one another in the lifting phase, which leads to jamming of the piston 13. This causes a high surface pressure with corresponding wear. Only when, after further rotation of the camshaft, the rocker arms 4 and 7 are running on the base circles of their cams can the piston 13 pass into its second end position. This process is unavoidable if all the pistons 13 are loaded simultaneously, because the cams associated with the valves of the various cylinders are offset relative to one another, for example by 90° in the case of a four-cylinder internal combustion engine.

In order to ensure that each piston 13 will reach its second end position when pressure is applied to it for the first time, an electromagnetic shut-off valve 22 is disposed in the channel 14, upstream of each cylinder I to IV in the direction of flow of the pressure medium indicated by the arrow P, such valve 22 having a closure member 23 which is slidable transversely to the longitudinal direction of the channel 14, and, in its closed position shown in FIGS. 1 and 2, shuts off the supply of pressure medium to the rocker arms 4 following in the direction of flow P, or to their bores 11, and is drawn back when the valve 22 is energized and frees the flow of pressure medium.

When the valves E are to be actuated by the high engine speed cams 8, the valves 22*a* to 22*d* are actuated, that is to say opened, one after the other in the direction of flow P of the pressure medium delivered from the pressure source 21, in such a manner that the supply of pressure medium to the pistons 13 of the rocker arms associated with the valves of the following cylinder takes place at phase of these rocker arms by at least the period of time $t_s$ a moment in time which precedes the commencement of the lifting required by the pistons 13 to reach their second end position. The valve 22*a* is thus opened first, in good time before commencement of the lifting phase of the valves of cylinder I, then the valve 22*b*, followed by the valve 22*c* and finally the valve 22*d*. It is thus ensured that none of the pistons 13 is loaded with pressure medium during the period of time $t_s$ before the commencement of the lifting phase of the respective valve, which time $t_s$ is required to bring the piston into its second end position. At least this period of time is thus always available for the coupling operation. The valves 22*a* to 22*d* are operated with the aid of the usual electronic engine control system by which the ignition timing for the individual cylinders is controlled and which, for example by means of a Hall effect device, detects the angular position of the camshaft and thus also the angular positions of the individual cams. The first valve 22*a* serves at the same time as a control valve, which is additionally controlled in dependence on operating parameters, particularly engine speed and the load on the internal combustion engine, in order for example to initiate, at a determined engine speed, the actuation of the valves by means of the high engine speed cams 8.

FIG. 3 shows a valve lift diagram for the inlet valves of a four-stroke internal combustion engine which has four cylinders I, II, III and IV and the ignition sequence 1-3-4-2. The period of time required by the piston 13 to reach its second end position is designated $t_x$. During this period of time the piston 13 must not be loaded with pressure medium, since otherwise there will be a risk that it will not reach its second end position before the commencement of the lifting phase and will therefore be subjected to increased surface pressure and increased wear. The change-over operation, that is to say the opening of the valve 22 in question, must therefore occur within the period of time $t_x$. If the ranges $t_x$ for cylinders following one another in the direction of flow p of the pressure medium overlap, it is possible to control by means of a single valve the flow of pressure medium to the pistons of the rocker arms for the valves of these cylinders. This is the case in the exemplary embodiment for the cylinders I and II and for the cylinders III and IV. The hatched bar A represents the period of time during which the change-over to the high engine speed cams 8 for the valves I and II can be made. The hatched bar B applies to the valves of cylinders III and IV. It can thus be seen that for this special case of a four- cylinder internal combustion engine with the ignition sequence 1-3-4-2 the valves **22*b* and 22*d*** can be dispensed with.

As can be seen in FIG. 3, the pressure loading is preferably already effected during the lifting phase of the valve in question, in order to be sure of having the entire base circle phase, that is to say the period of time between the lifting phases, available for the change-over operation. It is true that the bores 11 and 12 in the first rocker arms 4 and in the cross member 9 of the second rocker arm 7 are at first not yet in line, but this does no harm because they will come into line after completion of the lifting phase, that is to say after a very short time, and the piston 13 can then be pushed into the bore 12 to reach its second end position.

As previously mentioned, the bearings of the rocker arms 4and 7 are normally supplied with the pressure medium, as lubricant, through the channel 14 and the bores 19. Since this lubrication must also be effected when the valves 22 are closed, each closure member 23 is provided with a throttle point in the form of an annular groove 24 which, when the valve is closed, lies in the channel 14 and permits the supply of pressure medium as lubricant to the rocker arm bearings under lower pressure. On the closing of the first valve **22*a*, the pressure in the channel 14 is thus lowered by the throttle groove 24 of such valve to such an extent that all the pistons 13 can be returned by their spring 15** to their first end position.

Numerous modifications of the exemplary embodiment illustrated are obviously possible without going beyond the scope of the invention. Thus, in the exemplary embodiment illustrated, the channel 14 could be interrupted between the cylinders II and III and the pressure medium could be introduced not only from the right (in FIG. 2) but also from the left, the closure stopper 18 being dispensed with, in which case a valve corresponding to the valve **22*a*, and therefore also controlled by operating parameters, would then be provided in front of the left-hand end of the channel 14, and the valves 22*b*, 22*c* and 22*d*** lying therebetween could be dispensed with. It is obvious that the valve-actuating mechanism proposed is also suitable for an internal combustion engine which has only one inlet valve or more than two inlet valves per cylinder. The proposal according to the invention can also basically be applied to the outlet valves of the internal combustion engine.

I claim:

1. A valve actuating mechanism for a multicylinder internal combustion engine comprising:

at least one valve (E) per cylinder;

a camshaft including, for said at least one valve per cylinder, a first cam (2) for a lower engine speed range and a second cam (8) for an upper speed range;

first rocker arms (4), each of said first rocker arms cooperating with a valve and a first cam (2) and including a bore (11);

second rocker arms (7), each of said second rocker arms cooperating with a second cam (8) and including a bore (12);

a common shaft (5) for pivotally mounting each of said first and second rocker arms;

a coupling device between one of each of said first and said second rocker arms for each valve;

a pressure medium;

said coupling device including a piston (13) responsive to said pressure medium for moving from a first end position lying entirely within said bore (11) of said first rocker arm wherein said first and second rocker arms are uncoupled to a second end position partially projecting into said bore (12) of said second rocker arm wherein said first and second rocker arms are coupled;

said common shaft (5) including a longitudinal channel (14) in communication with said bore (11) of said first rocker arm;

a control valve (22a) connected between said pressure medium and said longitudinal channel (14) upstream of each cylinder in the direction of flow of said pressure medium in said longitudinal channel (14) for opening said longitudinal channel to said pressure medium in a timed sequence.

2. A valve-actuating mechanism according to claim 1 further including:

common shaft bearings and transverse channels (19) extending from said longitudinal channel to said bearings; and throttle channels in said control valves for permitting a throttled flow of said pressure medium through said transverse channels to said bearings.

3. A valve-actuating mechanism according to claim 2 wherein said control valves include closure members and said throttle channels are formed as peripheral grooves in said closure members.

4. A valve-actuating mechanism according to claim 1 wherein said common shaft supports rocker arms for valves of neighboring cylinders and including shaft bearings (6) for supporting said shaft and wherein said control valves are disposed in said shaft bearings.

5. A valve-actuating mechanism according to claim 1 wherein said control valves are solenoid valves.

* * * * *